US010322897B2

(12) United States Patent
Jariabka

(10) Patent No.: US 10,322,897 B2
(45) Date of Patent: Jun. 18, 2019

(54) PRINTING DEVICES

(71) Applicant: Hewlett-Packard Development Company, L.P., Houston, TX (US)

(72) Inventor: Keith Jariabka, Portland, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 15/748,377

(22) PCT Filed: Sep. 28, 2015

(86) PCT No.: PCT/US2015/052600
§ 371 (c)(1),
(2) Date: Jan. 29, 2018

(87) PCT Pub. No.: WO2017/058140
PCT Pub. Date: Apr. 6, 2017

(65) Prior Publication Data
US 2018/0215177 A1 Aug. 2, 2018

(51) Int. Cl.
*B65H 7/04* (2006.01)
*B41J 3/36* (2006.01)
(Continued)

(52) U.S. Cl.
CPC ..... *B65H 7/04* (2013.01); *B41J 3/36* (2013.01); *B41J 11/006* (2013.01);
(Continued)

(58) Field of Classification Search
CPC . B65H 5/06; B65H 5/062; B65H 7/00; B65H 7/02; B65H 7/04; B65H 7/06;
(Continued)

(56) References Cited

U.S. PATENT DOCUMENTS 5,383,731 A 1/1995 Hattori et al.
6,092,940 A 7/2000 Wiklof et al.
(Continued)

FOREIGN PATENT DOCUMENTS

WO WO-2004-056576 A1 7/2004

OTHER PUBLICATIONS

Sim, Hafeez. LG PD233 Pocket Photo Printer—Printing from Your Smartphone—Printers Guide—Aug. 6, 2015—6 pages.

*Primary Examiner* — Prasad V Gokhale
(74) *Attorney, Agent, or Firm* — Tong, Rea, Bentley & Kim LLC

(57) ABSTRACT

In one example, a printing device is described. The printing device may include a transport roller to move a print medium through the printing device, a sensor to detect a trailing edge of the print medium, a processor, and a non-transitory computer-readable medium storing instructions. In one example, the instructions, when executed by the processor, cause the processor to move the print medium toward an output of the printing device via the transport roller after a printing to the print medium, detect the trailing edge of the print medium via the sensor during a movement of the print medium via the transport roller, and hold the print medium in a position in contact with the transport roller, in response to a detection of the trailing edge of the print medium via the sensor.

14 Claims, 4 Drawing Sheets

(51) Int. Cl.

| | |
|---|---|
| ***B41J 29/38*** | (2006.01) |
| ***B41J 11/00*** | (2006.01) |
| ***B41J 13/00*** | (2006.01) |
| ***B41J 29/02*** | (2006.01) |
| ***B41J 13/02*** | (2006.01) |
| ***B65H 5/06*** | (2006.01) |
| ***B65H 7/14*** | (2006.01) |
| ***B65H 29/20*** | (2006.01) |

(52) U.S. Cl.
CPC ..... *B41J 11/0095* (2013.01); *B41J 13/0009* (2013.01); *B41J 13/0036* (2013.01); *B41J 13/02* (2013.01); *B41J 29/023* (2013.01); *B41J 29/38* (2013.01); *B65H 5/06* (2013.01); *B65H 7/14* (2013.01); *B65H 29/20* (2013.01); *B65H 2513/512* (2013.01)

(58) Field of Classification Search
CPC ..... B65H 7/14; B65H 7/20; B65H 29/125; B65H 29/20; B65H 2513/512
See application file for complete search history.

(56) References Cited

U.S. PATENT DOCUMENTS 6,666,605 B2 12/2003 Mantell
7,237,969 B2 7/2007 Bartman
7,524,121 B2 4/2009 Namekawa et al.
8,695,975 B2 * 4/2014 Seki ..... B65H 7/20 271/265.01
2002/0125632 A1 * 9/2002 Aoki ..... B65H 7/02 271/279
2005/0056993 A1 * 3/2005 Lee ..... B65H 27/00 271/314
2008/0309989 A1 * 12/2008 Shirai ..... B65H 7/06 358/474
2011/0097126 A1 * 4/2011 Kimura ..... B65H 29/125 399/405
2012/0056366 A1 3/2012 Sekino
2012/0069075 A1 * 3/2012 Pawlik ..... B41J 2/1752 347/16
2012/0217702 A1 * 8/2012 Seki ..... B65H 7/20 271/265.01
2013/0141487 A1 * 6/2013 Abe ..... B41J 11/00 347/16
2014/0035985 A1 * 2/2014 Arakane ..... B41J 13/0009 347/16
2014/0183811 A1 * 7/2014 Takenaka ..... B65H 43/02 271/3.19
2014/0265106 A1 * 9/2014 Saitoh ..... B65H 43/00 271/185
2015/0210492 A1 7/2015 Ormaechea Saracibar et al.

* cited by examiner

400

PRINTING DEVICES

BACKGROUND

Mobile printers, or portable printers, are useful in a variety of contexts. For example, various professionals such as real estate agents, closing agents, contractors and lawyers may have a need to print documents while away from an office. In addition, given the small size of mobile printers, many home users and office users may prefer such devices due to a lack of space.

DETAILED DESCRIPTION

Figure 1:
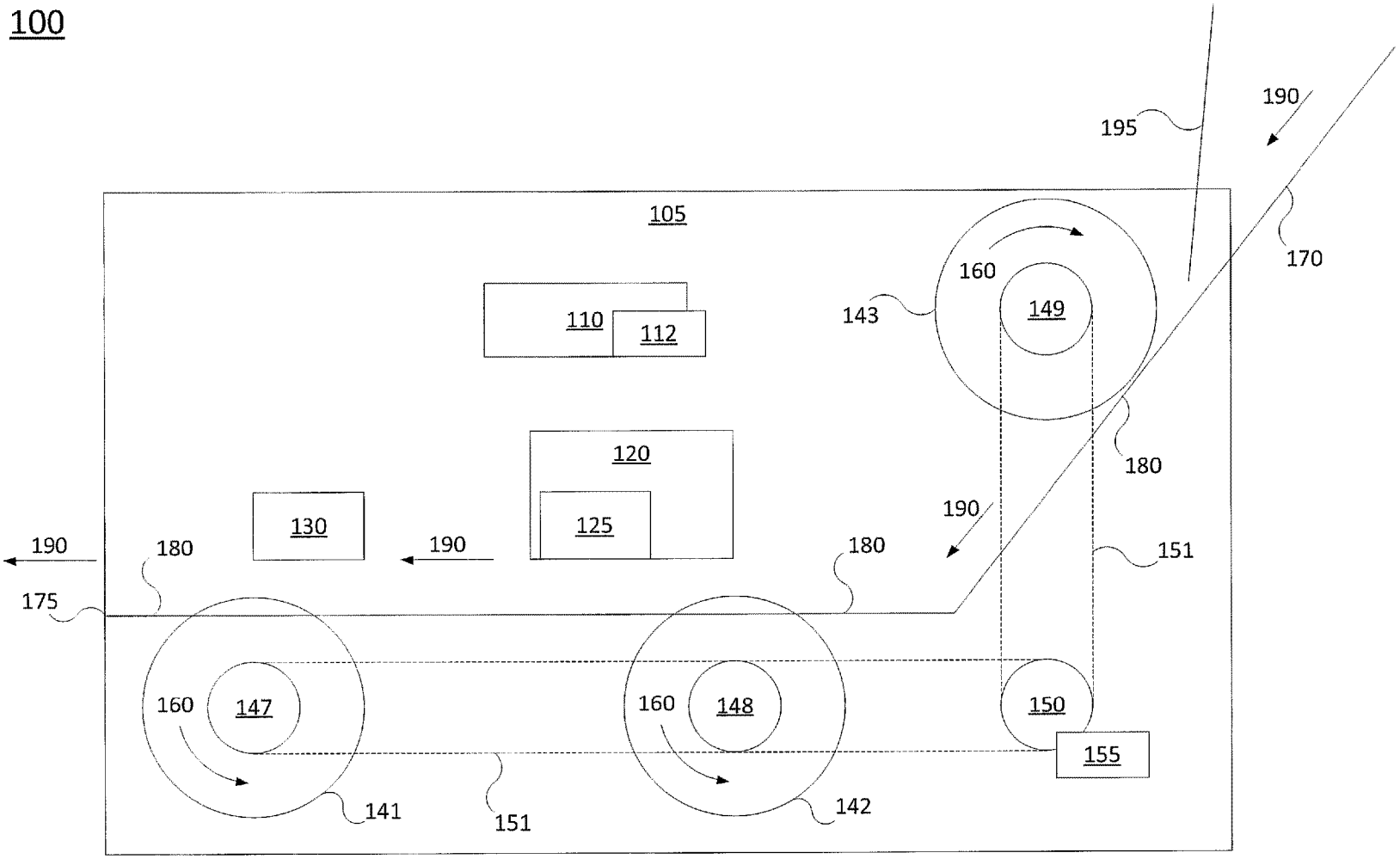
FIG. 1 illustrates a simplified diagram of an example printing device of the present disclosure.

In one example, a printing device is described. The printing device may include a transport roller to move a print medium through the printing device, a sensor to detect a trailing edge of the print medium, a processor, and a non-transitory computer-readable medium storing instructions. In one example, the instructions, when executed by the processor, cause the processor to move the print medium toward an output of the printing device via the transport roller after a printing to the print medium, detect the trailing edge of the print medium via the sensor during a movement of the print medium via the transport roller, and hold the print medium in a position in contact with the transport roller, in response to a detection of the trailing edge of the print medium via the sensor.

In another example, a non-transitory computer-readable medium storing instructions for a processor of a printing device is described. For example, the non-transitory computer-readable medium may store instructions which, when executed by the processor of the printing device, cause the processor to move a print medium toward an output of the printing device via a transport roller after a printing to the print medium, detect a trailing edge of the print medium via a sensor during a movement of the print medium via the transport roller, and hold the print medium in a position in contact with the transport roller, in response to a detection of the trailing edge of the print medium via the sensor.

In another example, a printing device is described. The printing device may include a transport roller to move a print medium through the printing device, a sensor to detect a trailing edge of the print medium during a movement of the print medium through the printing device, and a processor to halt a movement of the print medium by the transport roller in response to a detection of the trailing edge of the print medium by the sensor and to hold the print medium in a position contact with the transport roller when the movement of the print medium by the transport roller is halted by the processor.

As referred to herein, a printing device may comprise such devices as: a personal printer, a mobile printer or a portable printer, an ink-jet printer, a laser-jet printer, a digital press or digital printing press, an offset printing press, a printer-copier, a printer-scanner, a printer-copier-scanner, a printer-copier-fax, and so forth. In accordance with the present disclosure, a print medium may comprise such items as a sheet of paper or fabric, an envelope, a sheet of labels, and so forth. As used herein, the terms print medium, page, and sheet may all be used interchangeably, and are intended to refer to any types of print media that are capable of being printed on by a printing device.

For many mobile printing devices, no output tray exists to collect print medium after it is printed. Mobile printing devices may be transported virtually anywhere and are often used in unique locations where the lack of an output tray can put the print medium at risk of falling to the floor, being strewn across a table, being damaged because of objects in the way, and so forth. The compact nature of mobile printing devices also makes it compelling to place such printing devices on shelves or in other areas where the lack of an output tray can be problematic for a user. Although described primarily in the context of portable printing devices, the present disclosure is broadly applicable to any type of printing device that includes sensor hardware or that can be made to include sensor hardware for detecting a position of a printed page in the printing device.

In one example, the present disclosure comprises a printing device that uses a combination of a processor, a transport roller, and a hardware sensor to hold a print medium, e.g., a page, at the output of the printing device, without fully ejecting the page out of the printing device. In one example, the page remains "held" by a transport roller, such as an output roller, until manually removed by the user. In one example, the act of removing the page by the user automatically triggers a next page in the same print job, or a first page in a next print job to be printed. In one example, the process is repeated for subsequent pages of a print job and for subsequent print jobs in a print queue. In one example, the functions of the present disclosure may be referred to as a "virtual output tray." In one example, a virtual output tray may be enabled or disabled depending on the preferences of a user. For instance, the virtual output tray may include a firmware toggle that a user can use to enable or disable the feature.

In one example, the sensor comprises an optical sensor that is able to detect the trailing edge of a sheet of print medium as it is being ejected and to provide sensor readings to the processor. In one example, the sensor (e.g., an optical sensor) shines a light at the print medium and looks for reflections back from the print medium. When a print medium is present, there may be more reflection and hence more light detected by the sensor. The detection of a trailing edge of the print medium may allow the processor to control precisely how far the print medium is moved once printing is completed. In one example, the sensor may have other functions in addition to those described herein with respect to a virtual output tray. For instance, the sensor may comprise a component of a scanning print head assembly or other portions of the printing device for detecting top form, detecting side form, setting margins, and so forth. Many types of printing devices already include such a sensor, but do not use the sensor for the purposes described herein. Various other types of sensors may also be used in accordance with the present disclosure, such as a mechanical gate, or other type of sensor. In another example, a sensor may be omitted and the print medium may be held in a position in contact with a transport roller by estimating the position of the print medium. For example, it may be determined that a trailing edge margin is just past a print head assembly of the printing device when a last line of print data for the current print medium has been printed. In addition, it may be a known distance from the print head assembly to the transport roller where the print medium is to be held. Thus, the processor may cause the print medium to be advanced by this known distance at which point the movement of the print medium may be halted.

In another example, the sensor may be placed in an output system and/or in an output path of the printing device to detect the presence or absence of print medium. Functions of an output system may include controlling the print medium as it is being printed on and moving the print medium out of the printing device once the print medium is printed on. In one example, a sensor deployed in an output system may comprise an optical gate. When a print medium is present, it may block an optical path, and the absence or diminishment of light may correspond to the detection of a presence of the print medium. In another example, a reflection from a print medium, or a reflection from a mirror when a print medium covers the mirror, may be used to detect the presence or absence of the print medium, respectively. In one example, the sensor is dedicated to detecting the trailing edge of the print medium when it is in a certain location in the printing device, such as when the trailing edge of the print medium is still being held by a transport roller, such as an output roller, just before being ejected from the printing device. In one example, the sensor may report the detection of the presence and/or the absence of print medium to the processor to further control a transport roller of the printing device.

In one example, after printing is completed, the print medium may be placed in an output system and partially-ejected from the printing device by rotation of one or more transport rollers, such as an output roller, or "pinch roller." In one example, when a trailing edge of the print medium is detected by the sensor and reported to the processor, the rotation of a transport roller may be stopped by the processor. A portion of the print medium may then remain in contact with the transport roller, even if most of the print medium is hanging out of the printing device, lying on a table or shelf edge, and so forth.

In one example, the print medium remains "held" by the transport roller until it is physically grabbed and removed by the user. In one example, the act of removing the print medium, e.g., a page, by the user may automatically trigger the printing of a next page in a print job, if part of a multi-page print job, or a first page of a next print job, if additional print jobs are in a print queue of the printing device. In some examples, e.g., where the printing device is a compact portable printer and the sensor is contained in a print head assembly, the print medium may be retracted by the transport roller in order to place the trailing edge over the sensor. In one example, the removal of the print medium by the user or other force external to the printing device, e.g., a force not controlled by the printing device or any of the components of the printing device, is detected by a change in state of the sensor. For example, if the sensor is an optical gate, the sensor may detect a presence of a print medium in the held position in contact with the transport roller based upon an absence or a diminished level of light being detected, e.g., at sub-threshold levels, where the print medium is located in the optical path and preventing light from a light source from reaching a detector of the sensor. However, when the print medium is removed from the printing device, the print medium may no longer be located in the optical path of the sensor and the light from the light source may again be detected at above-threshold levels at a detector of the sensor.

In another example, the removal of the print medium by the user or other force external to the printing device is detected via a drive assembly of the printing device. For instance, a drive assembly may operate under the control of an encoder, or "disc encoder." In one example, the encoder may in turn be controlled by a processor of the printing device, as described herein. The encoder may control a driveshaft of the printing device that determines the positioning of print medium within printing device. The driveshaft may be coupled to one or more transport rollers in order to move and position the print medium. In one example, the encoder may also be used to detect movements of the driveshaft, e.g., rotational movements. Thus, with sufficient back force from the transport roller due to the movement of the print medium by the user or other external force, the driveshaft may also rotate in a manner that is detectable to the encoder. In one example, the encoder may further provide data regarding the movement of the driveshaft to the processor of the printing device, as described herein. Thus, in one example, the encoder may function as a sensor for detecting the removal of the print medium by an external force.

In another example, the print medium may be held at a position in contact with the transport roller until the user overrides the "virtual output tray," such as by entering an input via a control panel of the printing device or by entering an input via a user interface on a user device that submitted the print job to the printing device. For example, a message may be presented on a display of the printing device or on a connected user device, such as "please remove the printed page from the printer and press continue." In such case, the user input may also trigger the printing of a next print medium.

In one example, a printing device of the present disclosure may also provide a powered assist to eject a print medium from the printing device once it is detected that the print medium has been moved by an external force. For instance, a detection of a movement of the print medium via a sensor or via the drive assembly may indicate to the processor a direction that a user is attempting to pull the print medium. Thus, in one example, the processor may reactivate the transport roller to assist in moving the print medium in an output direction.

Even small retractable hardware output trays have measurable size and weight, which may prevent the inclusion of such output trays from various portable printing devices. Examples of the present disclosure address various inconveniences and inefficiencies by allowing a user to remove one sheet of print medium at a time from the printing device. In addition, a user may also have a print job that is of high importance or that is confidential such that the user would prefer the experience of pulling one sheet of print medium at a time. This could be the case of a real estate or insurance agent printing documents to be signed while with a customer. The agent may prefer the experience of taking one sheet of print medium at a time from the printing device and reviewing with the customer before moving onto the next sheet. In addition, for privacy and security purposes, the most an unintended viewer may see is a portion of a single page that is being held at the output of the printing device. These and other aspects of the present disclosure are described in greater detail below in connection with the example FIGS. 1-5.

FIG. 1 illustrates one example of a printing device 100 in which examples of the present disclosure may be implemented. For example, as shown in FIG. 1, printing device 100 includes a housing 105 and surfaces 180 for guiding print medium 195 from an input 170 to an output 175 of the printing device 100. A print path for the print medium 195 is indicated by the arrows 190. Along the print path may be several transport rollers 141, 142, and 143. Although three transport rollers are illustrated in FIG. 1, it should be noted that in other, further, and different printing devices, more or less transport rollers may be provided, and the transport rollers may be located in different positions, have different sizes, and so on depending upon the particular design of the printing device. In one example, transport roller 143 may comprise an input roller, e.g., a pick-feed roller, or the like. In one example, transport roller 142 may comprise an intermediate transport roller, or the like. In one example, transport roller 141 may comprise an output roller, a pinch roller, or the like. In one example, and as illustrated in FIG. 1, printing device 100 does not include an output tray. Rather, print medium exits from printing device 100 at output 175 following a printing to the print medium.

As illustrated in FIG. 1, printing device 100 may include a driveshaft 150 and an encoder 155. In one example, the driveshaft may be coupled to any one or more of transport rollers 141, 142, and 143 to provide a driving force to rotate the respective transport rollers. For instance, as illustrated in FIG. 1, driveshaft 150 may be coupled to portions 147, 148, and 149 of transport rollers 141, 142, and respectively, via drive components 151. In one example, encoder 155 comprises a disc encoder, or rotary encoder that translates an angular position and/or angular movement of driveshaft 150 into electrical control signals. Collectively, drive components 151, driveshaft 150, and encoder 155 may comprise all or a portion of a drive assembly of printing device 100. For illustrative purposes, drive components 151 are not intended to represent an actual physical configuration. As such, it will be appreciated that drive components 151 make take the form of an electromechanical motor, a servo, and multiple gears, arms, shafts, reducers, belts, cams, and so forth. The direction of rotation of each of the transport rollers 141, 142, and 143 for printing are illustrated by the respective arrows 160. For instance, rotations of the transport rollers 141, 142, and 142 as indicated by arrows 160 may assist to move a print medium 195 from the input 170 to the output 175 along the print path indicated by arrows 190.

In one example, the printing device 100 also includes a print head assembly 120, such as a scanning print head assembly or a stationary print head assembly, which may include a sensor 125 to detect a presence of a print medium, such as print medium 195. Besides sensor 125, the printing device 100 may alternatively or additionally include a sensor 130 in an output path of the printing device, e.g., after the print head assembly 120 and before the output 175 with reference to the forward printing direction indicated by arrows 190. Sensor 130 may also be used to detect a presence of a print medium. Each of the sensors 125 and 130 may comprise an optical sensor, or other type of sensor, as described above.

In one example, printing device 100 further includes a processor 110 to function as a controller for receiving data from and sending instructions to various components of printing device 100. An associated component 112, e.g., a non-transitory computer-readable medium, may store instructions for the processor to perform various operations and functions in connection with the present disclosure. In one example, processor 110 and component 112 may take the forms of processor 402 and component 405 of FIG. 4, as further discussed below. For illustrative purposes, connections between processor 110 and various components, such as sensor 125, sensor 130, transport rollers 141, 142, and 142, encoder 155, and so forth are omitted from FIG. 1.

Using printing device 100, a printing of print medium 195 may proceed as follows. Transport roller 143 may be engaged to begin moving the print medium 195 in the direction of arrows 190. Transport roller 142 may also be engaged to continue to move print medium 195 in the direction of arrows 190. In one example, engaging transport rollers 142 and 143 may include processor 110 providing commands or instructions to activate driveshaft 150 to begin rotating, and to engage transport rollers 142 and 143 with the driveshaft 150 via drive components 151, in order to activate transport rollers 142 and 143 and for transport rollers 142 and 143 to begin rotating in the directions indicated by arrows 160. As the print medium 195 passes the print head assembly 120, printing fluid, such as ink, toner, or the like, may be transferred to the print medium 195 via print head assembly 120. Transport roller 141 may also be engaged to assist in moving the print medium 195 out of the printing device 100 at output 175. However, prior to completely ejecting print medium 195 from the printing device 100, processor 110 may detect via sensor 125 and/or sensor 130 a position of the print medium 195. For example, sensor 125 and/or sensor 130 may detect a trailing edge of print medium 195 (where "trailing" refers to a back edge of the print medium in reference to the direction of arrows 190) and provide sensor readings to processor 110.

Upon determining that a trailing edge of the print medium 195 is present at sensor 125 or sensor 130, the processor may cause one or more of the transport rollers to disengage, e.g., to stop rotating and to stop moving the print medium 195 toward the output 175. Although a portion of print medium 195 may have already passed outside of the printing device 100 at output 175, a "trailing" portion of the print medium 195 may remain held within the printing device 100. For example, if a trailing edge of the print medium 195 is detected at sensor 130 and the movement of the print medium 195 is stopped, transport roller 141 may hold the print medium 195 in a stationary position. For instance, a frictional force from the transport roller 141 may hold the print medium in a position in contact with the transport roller 141. In one example, the print medium 195 may be pressed between transport roller 141 and another surface, such as a guide roller opposite the transport roller 141, in order to hold the print medium 195 in the "held" or stationary position. The holding force may be sufficient to prevent the print medium 195 from slipping or falling out of the printing device 100 at the output 175, but minimal enough such that a user may easily pull the print medium 195 out of the printing device 100 without tearing the print medium 195.

When a user or other external force causes the print medium 195 to be pulled away from the stationary position in contact with the transport roller 141, sensor 130 may detect a change in state, e.g., from the "print medium detected state" to the :print medium not detected state," and may provide sensor reading to the processor 110. Processor 110 may therefore be notified, or may calculate or determine that the print medium 195 has been removed or is in the process of being removed. In one example, processor 110 may engage components of the printing device 100 to print a next print medium when the movement of the print medium 195 is detected. Alternatively, or in addition, upon detecting that the print medium 195 is being removed, the processor 110 may reengage one or more of the transport rollers, e.g., transport roller 141, in order to provide assistance in moving the print medium 195 out of the printing device 100.

In another example, a trailing edge of the print medium 195 may be detected by processor 110 via sensor 125 in the print head assembly 120. In one example, processor 110 may actually retract the print medium 195, e.g., in a direction opposite to arrows 190 in order to hold the print medium 195 in a stationary position in contact with transport roller 142, while awaiting detection of a movement of the print medium 195 by an external force. In another example, the processor 110 may cause the print medium 195 to be advanced a certain distance in the direction of arrows 190 until a region of the print medium 195 at or near the trailing edge of print medium 195 is in contact with transport roller 141.

In one example, the movement of the print medium 195 may be detected via one of the sensors 125 or 130. However, in another example, the movement of the print medium 195 may be detected by a back-force on driveshaft 150. For instance, a pulling of the print medium 195 out of the output 175 in the direction of arrows 190 may cause transport roller 141 and/or transport roller 142 to rotate slightly in the directions of arrows 160. The rotation(s) of transport roller 141 and/or transport roller 142 may in turn cause a rotation of driveshaft 150 via the drive components 151. The rotation of driveshaft 150 due to this force may be detected by the encoder 155 and reported to the processor 110.

FIG. 1 illustrates just one example of a printing device in which examples of the present disclosure may be implemented. Thus, it should be noted that the printing device 100 has been simplified. For example, the printing device 100 may include other elements (not shown) such as electromechanical switches to engage and disengage transport rollers 141, 142, and 143 from the drive assembly 151, an input/output port, e.g., such as a serial input-output port, an Ethernet port, a uniform serial bus (USB) port, a wireless transceiver, or the like, a user interface and display, additional sensors deployed along the print path and or deployed transverse to the print path in line with sensor 125 or in line with sensor 130, and so on. In addition, a printing device in which examples of the present disclosure may be implemented may further omit various elements, or include different elements according to the various types of printing device designs. For instance, printing device 100 may represent a mobile/portable ink-jet printer with a scanning print head assembly, whereas another example may comprise a laser-jet printer, a printer-scanner, and so on.

Figure 2:
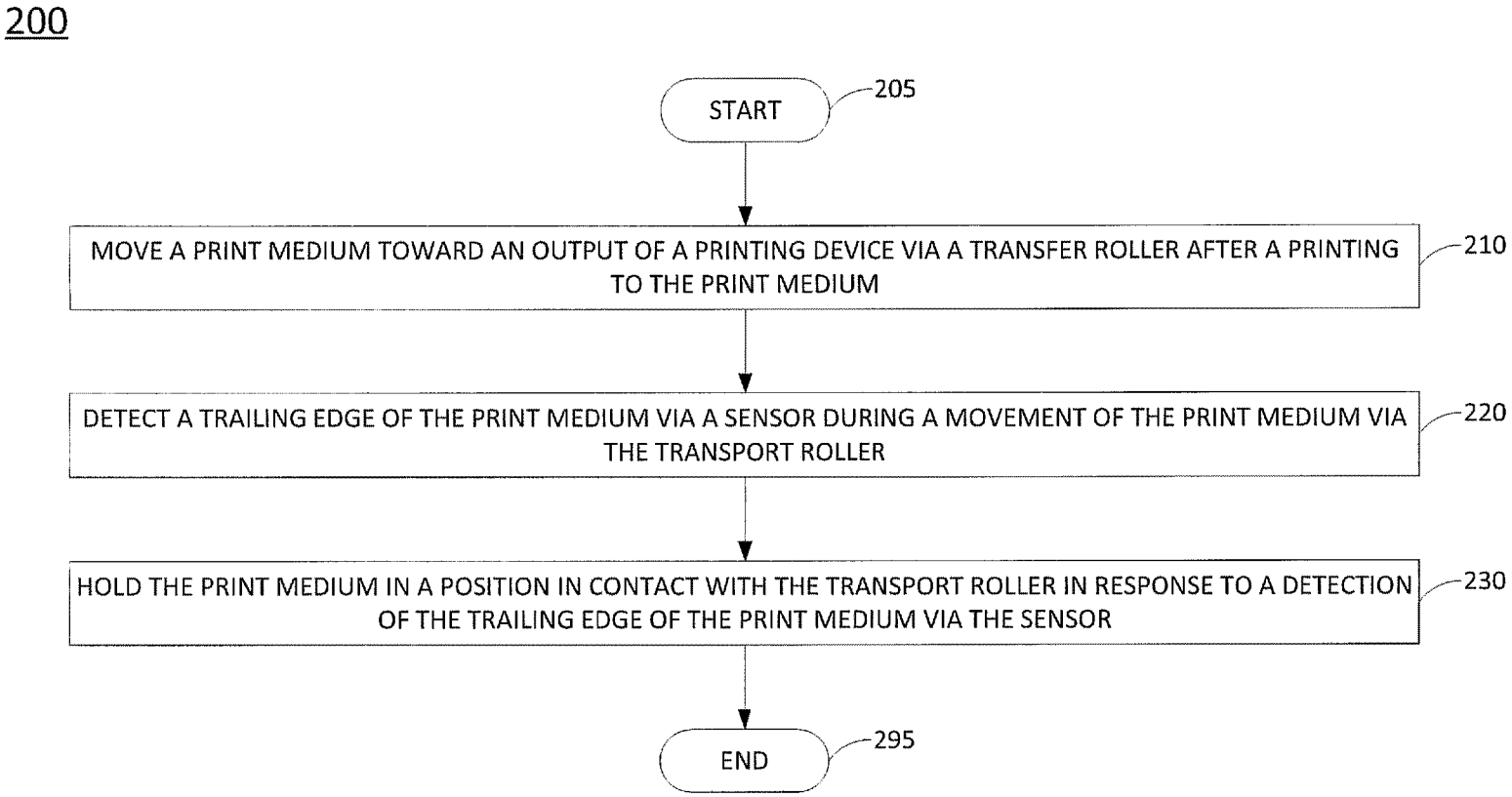
FIG. 2 illustrates a flowchart of an example method for holding a print medium in a position in contact with a transport roller.

FIG. 2 illustrates a flowchart of an example method 200 for holding the print medium in a stationary position in contact with a transport roller. The method 200 may be performed, for example, by any one or more of the components of the printing device 100 illustrated in FIG. 1. For instance, the method 200 may be performed by processor 110, or by processor 110 in coordination with sensor 125 and/or sensor 130, one or more of transport rollers 141, 142, or 143, components of a drive assembly, and so forth. However, the method 200 is not limited to implementation with the printing device 100 of FIG. 1, but may be applied in connection with any number of types of printing devices having various configurations. Alternatively, or in addition, one or more blocks of the method 200 may be implemented by a printing device, e.g., a computing device having a processor, a memory, and input/output devices as illustrated below in FIG. 4, specifically programmed to perform the blocks of the method. Although any one or more of the elements of printing device 100 of FIG. 1 or a similar system may be configured to perform various blocks of the method 200, the method will now be described in terms of an example where blocks of the method are performed by a processor, such as processor 402 in FIG. 4. For example, processor 402 may comprises a processor of a printing device. It should be noted that where a processor is described as performing operations in connection with blocks of the method 200, the operations may comprise the processor itself performing the operations, or may comprise the processor performing the operations via one or more other elements in coordination by the processor.

The method 200 begins in block 205. In block 210, the processor may move a print medium toward an output of a printing device via a transport roller after a printing to the print medium. In one example, the processor may engage the transport roller, e.g., by activating the transport roller to begin rotating, via a drive assembly comprising an encoder, a driveshaft, a motor, and so forth. In one example, the printing may be completed by a print head assembly of the printing device. In one example, the transport roller may comprise an output roller. In another example, the transport roller may comprise an intermediate transport roller.

In block 220, the processor may detect a trailing edge of the print medium via a sensor during a movement of the print medium via the transport roller. In one example, the sensor may comprise a sensor in a print head assembly of the printing device. In another example, the sensor may comprise a sensor in an output path of the printing device, e.g., located between a print head assembly and a transport roller, such as an output roller, along a print path of the printing device. In one example, the sensor may comprise an optical sensor, such as an optical gate to detect the presence and absence of light, or to detect light levels above and below a threshold for determining the presence or absence of a print medium. In one example, the sensor is to detect a trailing edge of the print medium, e.g., a back edge of the print medium with respect to a print direction of the printing device.

In block 230, the processor may hold the print medium in a stationary position in contact with the transport roller, in response to a detection of the trailing edge of the print medium via the sensor at block 220. In one example, the position in contact with the transport roller comprises a stationary position, where the transport roller is stationary/not rotating and where the print medium is also held stationary. In one example, the processor may halt a movement of the print medium by the transport roller in response to a detection at block 220 of the trailing edge of the print medium via the sensor. In one example, the processor may disengage the transport roller from a driveshaft via one or more drive components. In another example, the processor may stop a driveshaft from rotating, thereby also stopping the transport roller to which it may be coupled. In one example, the print medium may be held in the position in contact with the transport roller by a frictional force from the transport roller. For instance, the transport roller may pinch the print medium against a surface opposite to the transport roller.

In one example, the processor may advance or retract the print medium after the sensor detects the trailing edge of the print medium at block 220 in order to place the print medium in a position in contact with the transport roller. In one example, the processor may also position the print medium such that a portion of the print medium at or near the trailing edge is placed over the sensor, such that the sensor detects a presence of the print medium. In one example, a portion of the print medium may be hanging out of the printing device or lying on a surface, such as on a desk, table, or floor, when the print medium is held in the position in contact with the transport roller. However, by retaining at least a trailing portion of the print medium inside the printing device and by holding the print medium in contact with the transport roller, the print medium is prevented from being completely strewn about.

Following block 230, the method 200 proceeds to block 295 where the method ends.

Figure 3:
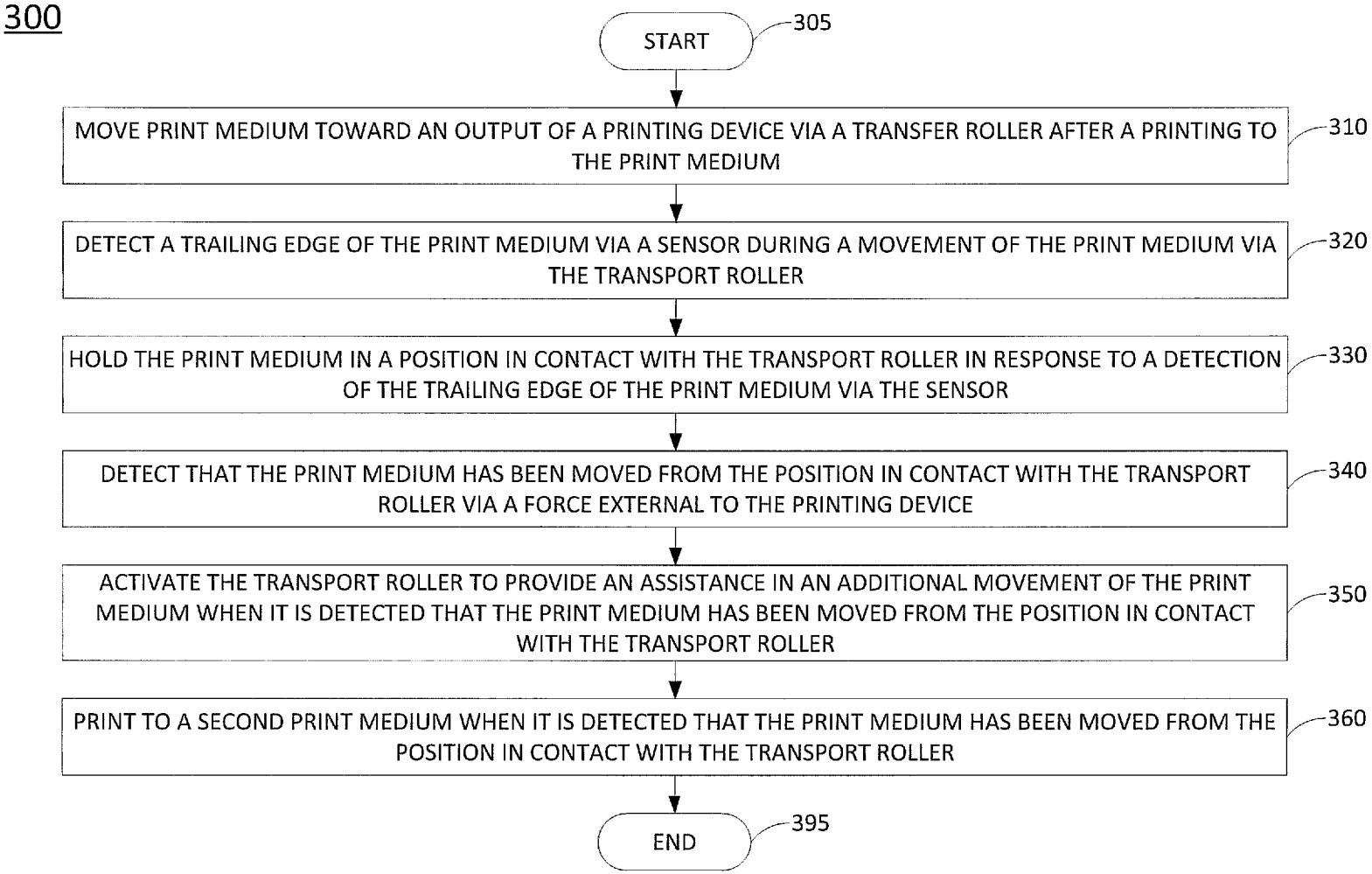
FIG. 3 illustrates an additional flowchart of an example method for holding a print medium in a position in contact with a transport roller.

FIG. 3 illustrates a flowchart of an example method 300 for holding print medium in a position in contact with a transport roller. The method 300 may be performed, for example, by any one or more of the components of the printing device 100 illustrated in FIG. 1. For instance, the method 300 may be performed by processor 110, or by processor 110 in coordination with sensor 125 and/or sensor 130, one or more of transport rollers 141, 142, or 143, components of a drive assembly, and so forth. However, the method 300 is not limited to implementation with the printing device 100 of FIG. 1, but may be applied in connection with any number of types of printing devices having various configurations. Alternatively, or in addition, one or more blocks of the method 300 may be implemented by a printing device, e.g., a computing device having a processor, a memory, and input/output devices as illustrated below in FIG. 4, specifically programmed to perform the blocks of the method. Although any one or more of the elements of printing device 100 of FIG. 1 or a similar system may be configured to perform various blocks of the method 300, the method will now be described in terms of an example where blocks of the method are performed by a processor, such as processor 402 in FIG. 4. For example, processor 402 may comprise a processor of a printing device. It should be noted that where a processor is described as performing operations in connection with blocks of the method 300, the operations may comprise the processor itself performing the operations, or may comprise the processor performing the operations via one or more other elements in coordination by the processor.

The method 300 begins in block 305. In block 310, the processor may move a print medium toward an output of a printing device via a transport roller after a printing to the print medium. In one example, the operations of block 310 may comprise the same or similar operations to those described above in connection with block 210 of FIG. 2.

In block 320, the processor may detect a trailing edge of the print medium via a sensor during a movement of the print medium via the transport roller. In one example, the sensor may comprise a sensor in a print head assembly of the printing device. In another example, the sensor may comprise a sensor in an output path of the printing device, e.g., located between a print head assembly and a transport roller, such as an output roller, along a print path of the printing device. In one example, the sensor may comprise an optical sensor, such as an optical gate to detect the presence and absence of light, or to detect light levels above and below a threshold for determining the presence or absence of a print medium. In one example, the sensor is to detect a trailing edge of the print medium. In one example, the operations of block 320 may comprise the same or similar operations to those described above in connection with block 220 of FIG. 2.

In block 330, the processor may hold the print medium in a position in contact with the transport roller, in response to a detection of the trailing edge of the print medium via the sensor at block 220. In one example, the processor may also position the print medium such that the trailing edge is placed over the sensor. In other words, the print medium may be placed in a position where a portion of the print medium at or near the trailing edge covers the sensor, such that the sensor detects a presence of the print medium. In one example, the operations of block 330 may comprise the same or similar operations to those described above in connection with block 230 of FIG. 2.

In block 340, the processor may detect that the print medium has been moved from the position in contact with the transport roller via a force external to the printing device. For instance, a user may grab the print medium or begin to remove the print medium from the printing device. In one example, the force may be sufficient to overcome a frictional force of the transport roller that is keeping the print medium in a stationary position in contact with the transport roller. In one example, the processor detects that the print medium has been moved from the position in contact with the transport roller via a force external to the printing device when it is detected that the print medium has been moved or is moving without the processor providing instructions to any components of the printing device to engage, rotate, and/or to otherwise move the print medium.

In one example, the processor detects a movement of the print medium from the position in contact with the transport roller via the sensor. For example, as described above, at block 330, the processor may position the print medium such that a portion of the print medium at or near the trailing edge is placed over the sensor. As such, the sensor may detect a change in state, e.g., a "print medium present state" to a "no print medium present state," when the print medium is moved by the external force, and may report the change in state to the processor. In another example, a movement of the print medium may be detected by a different sensor. For example, the printing device may have a linear arrangement of sensors perpendicular to a print direction, or another configuration, where any one or more of the sensors may be used to detect a trailing edge of the print medium. As such, a first sensor or sensors may be used by the processor to determine when to stop advancing the print medium at blocks 320 and 330, while a second sensor, or set of sensors may be used by the processor to detect that the print medium has been moved at block 350.

In another example, the removal of the print medium may be detected by the processor at block 340 via a drive assembly of the printing device. For instance, a pulling of the print medium by the user may provide sufficient back force from the transport roller due to the movement of the print medium such that a rotation of the transport roller may also cause a rotation of the driveshaft to which the transport roller is coupled via the drive components. In addition, the rotation of the driveshaft may be detected by an encoder of the drive assembly, which may further provide data regarding the movement of the driveshaft to the processor. Thus, in one example, the encoder may function as a sensor for detecting the removal of the print medium by an external force at block 340.

In still another example, the removal of the print medium via an external force may be detected by the processor at block 340 via a user input. For instance, the processor may receive a user input that is provided via a control panel of the printing device or from a user interface on a user device that submitted the print job to the printing device. For example, a message may be presented on a display of the printing device or on a connected user device, such as "please remove the printed page from the printer and press continue."

In block 350, the processor may activate the transport roller to provide an assistance in an additional movement of the print medium when it is detected at block 340 that the print medium has been moved from the position in contact with the transport roller. For example, a detection of a movement of the print medium via a sensor or via a drive assembly may indicate to the processor a direction that a user is attempting to pull the print medium, e.g., in an output direction. Thus, in one example, the processor may reactivate the transport roller to assist in moving the print medium in an output direction.

In block 360, the processor may print to a second print medium when it is detected at block 340 that the print medium has been moved from the position in contact with the transport roller. For example, the removal of a print medium, e.g., a page, by a user may automatically trigger a next page in a same print job, or a first page in a next print job to be printed.

Following block 360, the method 300 proceeds to block 395 where the method ends.

It should be noted that in one example, the blocks of the method 300 may be repeated for subsequent pages of a print job and for subsequent print jobs in a print queue. For instance, pages of print medium may be printed one at a time, where the next page is not printed until the previous page is removed by the user. As such, while a printing device of the method 300 may omit a hardware output tray, the printing device may be used in a variety of useful contexts, such as placing the printing device on an elevated shelf, where print medium may be retrieved from the printing device in an orderly manner, without the print medium being strewn about. Furthermore, for privacy and security purposes, the most an unintended viewer may see is a portion of a single page that is being held at the output of the printing device.

In addition, although not explicitly specified, one or more blocks, functions, or operations of the methods 200 and 300 described above may include storing, displaying, and/or outputting. In other words, any data, records, fields, and/or intermediate results discussed in the methods can be stored, displayed, and/or outputted to another device depending on the particular application. Furthermore, blocks, functions, or operations in FIGS. 2 and 3 that recite a determining operation, or involve a decision, do not necessarily imply that both branches of the determining operation are practiced. In other words, one of the branches of the determining operation can be deemed as optional. In addition, various blocks of the respective methods 200 and 300 may be considered optional in various examples. For instance, in one example, method 300 may omit block 350. In another example, method 300 may omit block 360. In addition, it should be noted that the respective methods 200 and 300 may also be expanded to include additional operations and functions as described above in connection with various examples.

Figure 4:
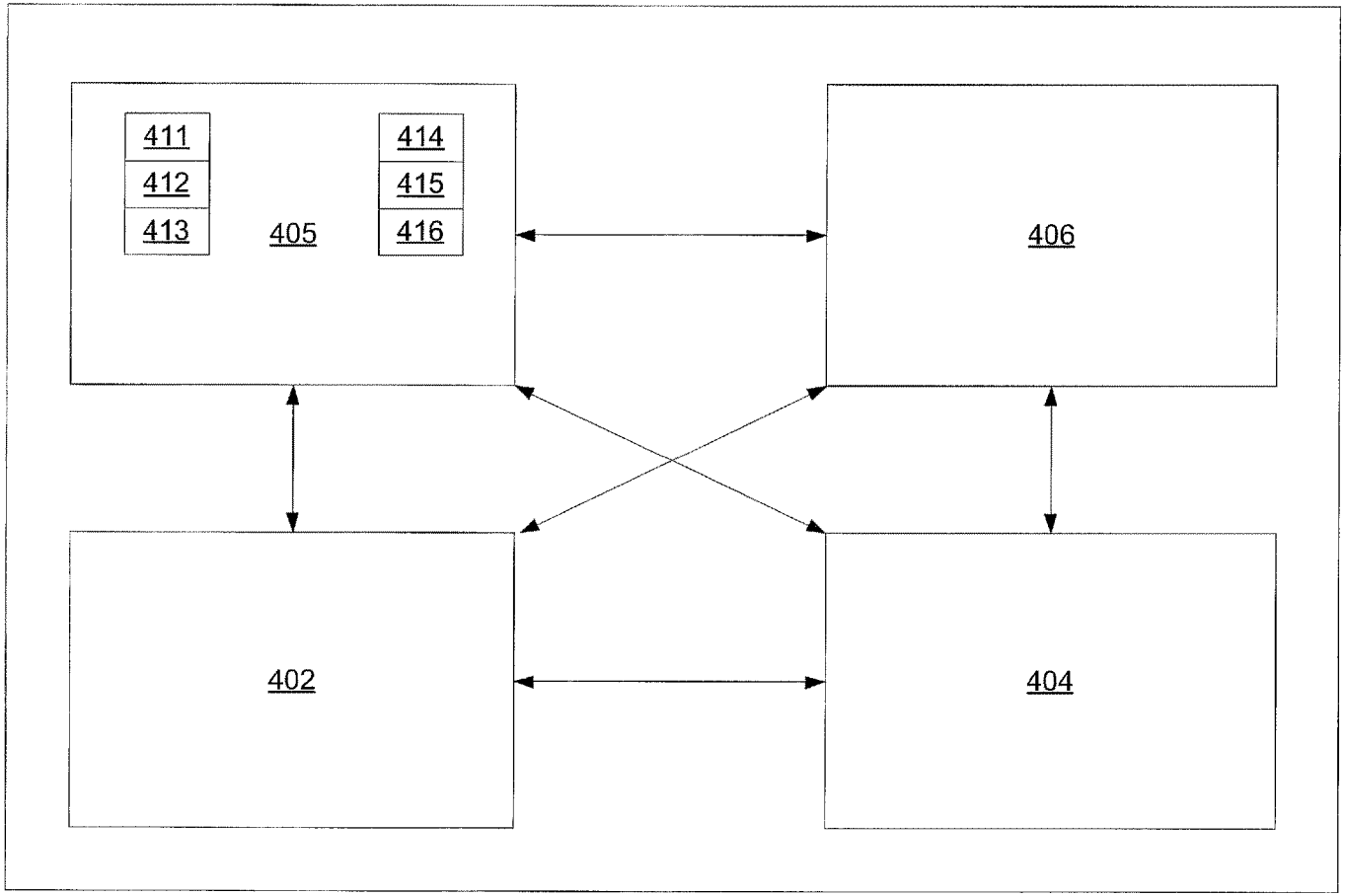
FIG. 4 depicts a high-level block diagram of an example computer that can be transformed into a machine capable of performing the functions described herein.

FIG. 4 depicts an example high-level block diagram of a computing device suitable for use in performing the functions of a printing device as described herein. As depicted in FIG. 4, the computer 400 comprises a hardware processor element 402, e.g., a central processing unit (CPU), a microprocessor, or a multi-core processor, a memory 404, e.g., random access memory (RAM), a component 405 for holding print medium in a position in contact with a transport roller, and various input/output devices 406, e.g., storage devices, including but not limited to, a tape drive, a floppy drive, a hard disk drive or a compact disk drive, a receiver, a transmitter, a speaker, a display, a speech synthesizer, an output port, an input port and a user input device, such as a keyboard, a keypad, a mouse, a microphone, and the like. Although one processor element is shown, it should be noted that the computer may employ a plurality of processor elements. Furthermore, although one computer is shown in the figure, if the method(s) as discussed above is implemented in a distributed or parallel manner for a particular illustrative example, i.e., the blocks of the above method(s) or the entire method(s) are implemented across multiple or parallel computers, then the computer of this figure is intended to represent each of those multiple computers.

It should be noted that the present disclosure can be implemented by machine readable instructions and/or in a combination of machine readable instructions and hardware, e.g., using application specific integrated circuits (ASIC), a programmable logic array (PLA), including a field-programmable gate array (FPGA), or a state machine deployed on a hardware device, a computer or any other hardware equivalents, e.g., computer-readable instructions pertaining to the method(s) discussed above can be used to configure a hardware processor to perform the blocks, functions and/or operations of the above disclosed methods.

In one example, instructions and data for the present component or process 405 for holding a print medium in a position in contact with a transport roller, e.g., machine readable instructions, can be loaded into memory 404 and executed by hardware processor element 402 to implement the blocks, functions, or operations as discussed above in connection with the example methods 200 and 300. For instance, in one example, the component 405 may include a plurality of computer-readable components, including a move print medium component 411, a detect trailing edge component 412, a hold print medium component 413, a detect movement of print medium component 414, an activate transport roller to assist component 415, and a print to second print medium component 416. When executed by the hardware processor element 402 the move print medium component 411 may cause the hardware processor element 402 to move a print medium toward an output of a printing device via a transport roller after a printing to the print medium, the detect trailing edge component 412 may cause the hardware processor element 402 to detect a trailing edge of the print medium via a sensor during a movement of the print medium via the transport roller, the hold print medium component 413 may cause the hardware processor element 402 to hold the print medium in a position in contact with the transport roller, in response to a detection of the trailing edge of the print medium via the sensor, the detect movement of print medium component 414 may cause the hardware processor element 402 to detect that the print medium has been moved from the position in contact with the transport roller via a force external to the printing device, the activate transport roller to assist component 415 may cause the hardware processor element 402 to activate the transport roller to provide an assistance in an additional movement of the print medium when it is detected that the print medium has been moved from the position in contact with the transport roller, and the print to second print medium component 416 may cause the hardware processor element 402 to print to a second print medium when it is detected that the print medium has been moved from the position in contact with the transport roller. For example, the foregoing configuration of component 405 may cause the hardware processor element 402 and/or the computing device of FIG. 4 to perform the functions of a printing device of the present disclosure. The foregoing is just one example configuration of component 405 in accordance with the present disclosure.

Furthermore, when a hardware processor executes instructions to perform "operations," this could include the hardware processor performing the operations directly and/or facilitating, directing, or cooperating with another hardware device or component, e.g., a co-processor and the like, to perform the operations.

The processor executing the machine readable instructions relating to the above described method(s) can be perceived as a programmed processor or a specialized processor. As such, the present component 405 for holding a print medium in a position in contact with a transport roller, including associated data structures, of the present disclosure can be stored on a tangible or physical (broadly non-transitory) computer-readable storage device or medium, e.g., volatile memory, non-volatile memory, ROM memory, RAM memory, magnetic or optical drive, device or diskette and the like. Furthermore, the computer-readable storage device may comprise any physical device or devices that provide the ability to store information such as data and/or instructions to be accessed by a processor or a computing device such as a computer or an application server.

It will be appreciated that variants of the above-disclosed and other features and functions, or alternatives thereof, may be combined into many other different systems or applications. Various presently unforeseen or unanticipated alternatives, modifications, or variations therein may be subsequently made, which are also intended to be encompassed by the following claims.

What is claimed is:

1. A printing device, comprising:

a transport roller to move a first print medium through the printing device after a printing to the first print medium;

a sensor to detect a trailing edge of the first print medium;

a processor; and a non-transitory computer-readable medium storing instructions which, when executed by the processor, cause the processor to:

move the first print medium toward an output of the printing device via the transport roller after the printing to the first print medium;

detect the trailing edge of the first print medium via the sensor during a movement of the first print medium via the transport roller;

hold the first print medium in a first position in contact with the transport roller, in response to a detection of the trailing edge of the first print medium via the sensor;

receive a user input, via an input device, the user input indicating that the first print medium has been moved from the first position in contact with the transport roller; and print to a second print medium when the user input indicating that the first print medium has been moved from the first position in contact with the transport roller is received.

2. The printing device of claim 1, wherein the non-transitory computer-readable medium stores further instructions which, when executed by the processor, cause the processor to:

detect, via a second sensor, that the first print medium has been moved from the first position in contact with the transport roller via a force external to the printing device; and print to the second print medium when it is detected that the first print medium has been moved from the first position in contact with the transport roller.

3. The printing device of claim 2, wherein the further instructions, when executed by the processor, cause the processor to detect, via a second sensor, that the first print medium has been moved from the first position in contact with the transport roller.

4. The printing device of claim 2, further comprising:

a drive assembly coupled to the transport roller, wherein the further instructions, when executed by the processor, cause the processor to detect, via an encoder to detect a movement of the drive assembly, that the first print medium has been displaced from the first position in contact with the transport roller.

5. The printing device of claim 1, wherein the transport roller is to provide a frictional force to hold the first print medium in the first position in contact with the transport roller.

6. The printing device of claim 1, wherein the transport roller comprises an output roller.

7. The printing device of claim 1, wherein the sensor comprises a sensor of a print head assembly.

8. The printing device of claim 1, wherein the sensor comprises an optical sensor.

9. The printing device of claim 1, wherein the sensor is deployed in an output path of the printing device.

10. A non-transitory computer-readable medium storing instructions which, when executed by a processor of a printing device, cause the processor to:

move a print medium toward an output of the printing device via a transport roller after a printing to the print medium;

detect a trailing edge of the print medium via a sensor during a movement of the print medium via the transport roller after the printing to the print medium;

hold the print medium in a first position in contact with the transport roller, in response to a detection of the trailing edge of the print medium via the sensor;

receive a user input, via an input device, the user input indicating that the print medium has been moved from the first position in contact with the transport roller; and print to a second print medium when the user input indicating that the first print medium has been moved from the first position in contact with the transport roller is received.

11. The non-transitory computer-readable medium of claim 10, storing further instructions which, when executed by the processor, cause the processor to:

detect, via a second sensor, that the print medium has been moved from the first position in contact with the transport roller via a force external to the printing device; and activate the transport roller when it is detected that the print medium has been moved from the first position in contact with the transport roller.

12. A printing device, comprising:

a transport roller to move a first print medium through the printing device after a printing to the first print medium;

a sensor to detect a trailing edge of the first print medium during a movement of the first print medium through the printing device after the printing to the first print medium; and a processor to halt a movement of the first print medium by the transport roller in response to a detection of the trailing edge of the first print medium by the sensor, wherein the transport roller is to hold the first print medium in a first position in contact with the transport roller when the movement of the first print medium by the transport roller is halted by the processor, to receive a user input, via an input device, the user input indicating that the first print medium has been moved from the first position in contact with the transport roller, and to print to a second print medium when the user input indicating that the first print medium has been moved from the first position in contact with the transport roller is received.

13. The printing device of claim 12, wherein the processor is further to:

detect, via a second sensor, that the first print medium has been moved from the first position in contact with the transport roller; and print to a second print medium when it is detected that the first print medium has been moved from the first position in contact with the transport roller.

14. The printing device of claim 12, wherein the processor is further to:

detect, via a second sensor, that the first print medium has been moved from the first position in contact with the transport roller via a force external to the printing device; and activate the transport roller when it is detected that the first print medium has been moved from the first position in contact with the transport roller.

* * * * *